US010040299B2

(12) United States Patent
Chanclón Fernández et al.

(10) Patent No.: US 10,040,299 B2
(45) Date of Patent: Aug. 7, 2018

(54) PRINTING APPARATUS AND PRINTING METHODS

(71) Applicant: Hewlett-Packard Development Company, L.P., Houston, TX (US)

(72) Inventors: Ismael Chanclón Fernández, Sant Cugat del Valles (ES); Félix Ruíz Martínez, Sant Cugat del Vales (ES); Javier González Bruno, Sant Cugat del Valles (ES); Eduardo Martín Orue, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/762,433

(22) PCT Filed: Jan. 25, 2013

(86) PCT No.: PCT/EP2013/051486

§ 371 (c)(1),
(2) Date: Jul. 21, 2015

(87) PCT Pub. No.: WO2014/114351

PCT Pub. Date: Jul. 31, 2014

(65) Prior Publication Data

US 2015/0328903 A1 Nov. 19, 2015

(51) Int. Cl.
*B41J 11/00* (2006.01)
*B65H 5/06* (2006.01)
(Continued)

(52) U.S. Cl.
CPC ..... *B41J 11/006* (2013.01); *B41J 15/005* (2013.01); *B41J 15/16* (2013.01); *B65H 5/068* (2013.01);
(Continued)

(58) Field of Classification Search
CPC .... B65H 29/68; B65H 2515/31; B65H 23/00; B65H 5/068; B41J 11/006; B41J 15/005
(Continued)

(56) References Cited

U.S. PATENT DOCUMENTS 3,707,215 A 12/1972 Familant
4,426,653 A * 1/1984 Komada ..... H04N 1/0057 347/153
(Continued)

FOREIGN PATENT DOCUMENTS

CN 1448273 10/2003
CN 1657303 8/2005
(Continued)

OTHER PUBLICATIONS

Machine translation of JP 9-85974.*
(Continued)

*Primary Examiner* — Thomas A Morrison
(74) *Attorney, Agent, or Firm* — HP Inc. Patent Department

(57) ABSTRACT

A printing apparatus comprises a print zone and a media handling system for advancing media through a media path and through the print zone, wherein the media handling system comprises a first media driving arrangement positioned downstream of the print zone in the direction of advance of the media, and a second media driving arrangement positioned downstream of the first arrangement, the second media driving arrangement being operable to cause the tension of the media in a deformation zone between the two driving arrangements to be lower than the tension of the media in the print zone.

16 Claims, 2 Drawing Sheets

Figure 1:
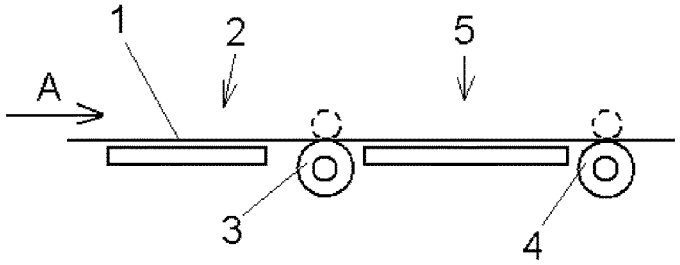

(51) Int. Cl.

| | |
|---|---|
| ***B65H 7/14*** | (2006.01) |
| ***B65H 7/20*** | (2006.01) |
| ***B65H 43/08*** | (2006.01) |
| ***B65H 23/00*** | (2006.01) |
| ***B41J 15/00*** | (2006.01) |
| ***B41J 15/16*** | (2006.01) |

(52) U.S. Cl.
CPC ..... *B65H 7/14* (2013.01); *B65H 7/20* (2013.01); *B65H 23/00* (2013.01); *B65H 43/08* (2013.01)

(58) Field of Classification Search
USPC ..... 271/270, 272–274, 314; 347/104; 399/68
See application file for complete search history.

(56) References Cited

U.S. PATENT DOCUMENTS

| | | | | |
|---|---|---|---|---|
| 6,668,155 | B1 | 12/2003 | Hubble et al. | |
| 7,426,353 | B1 * | 9/2008 | Sakakibara | 399/68 |
| 7,634,208 | B2 * | 12/2009 | Sugiyama | 399/68 |
| 7,690,651 | B2 * | 4/2010 | Kubochi | 271/265.01 |
| 8,150,287 | B2 * | 4/2012 | Souda | 399/68 |
| 2002/0057321 | A1 * | 5/2002 | Rasmussen | B41J 11/005 347/101 |
| 2003/0189629 | A1 * | 10/2003 | Tsuji et al. | 347/104 |
| 2005/0140767 | A1 * | 6/2005 | Kaga et al. | 347/104 |
| 2005/0186008 | A1 | 8/2005 | Imai | |
| 2006/0125899 | A1 | 6/2006 | Cornish et al. | |
| 2009/0016797 | A1 | 1/2009 | Brugue et al. | |
| 2010/0086338 | A1 | 4/2010 | Hara et al. | |
| 2012/0024124 | A1 * | 2/2012 | Mitsuhashi | 83/401 |
| 2012/0062677 | A1 * | 3/2012 | Sawada | 347/104 |
| 2013/0235139 | A1 * | 9/2013 | Schnabel et al. | 347/104 |

FOREIGN PATENT DOCUMENTS

| | | | |
|---|---|---|---|
| CN | 1798657 | | 7/2006 |
| CN | 102343727 | | 2/2012 |
| JP | 9-85974 | * | 3/1997 |
| JP | H10-129054 | | 5/1998 |
| JP | 2001-121763 | | 5/2001 |
| JP | 2005-262877 | | 9/2005 |
| JP | 2012-025577 | | 2/2012 |
| JP | 2012-162379 | | 8/2012 |
| KR | 1020040024261 | | 3/2004 |
| KR | 1020070033849 | | 3/2007 |

OTHER PUBLICATIONS

International Search Report and Written Opinion dated Oct. 10, 2013, issued on PCT Patent Application No. PCT/EP2013/051486, filed Jan. 25, 2013, European Patent Office.

* cited by examiner

PRINTING APPARATUS AND PRINTING METHODS

CLAIM FOR PRIORITY

The present application is a national stage filing under 35 U.S.C 371 of PCT application number PCT/EP2013/051486, having an international filing date of Jan. 25, 2013, the disclosure of which is hereby incorporated by reference in its entirety.

Some known printing apparatus, e.g. large format inkjet printers, have a paper handling system for advancing paper or other media through a media path and through the print zone. The handling system may comprise a feed roller upstream of the print zone, and a so-called overdrive roller downstream of the print zone; a small amount of slippage is permissible between the overdrive roller and the media. The tangential speed of the surface of the overdrive roller (driving speed of the overdrive roller) may be slightly higher than the tangential speed of the surface of the feed roller (driving speed of the feed roller), and this helps maintaining the media flat in the print zone.

However, in some printers there is a risk that media jams occur in the print zone while printing. Media advancing through a media path is subject to tensions, for example due to mechanical causes such as misalignment between two axes of the advance system.

Due to such tensions, the media may tend to form a media bubble, such that the media tends to deform and lift from an underlying platen of the apparatus: it has now been found that a bubble may form in the print zone, or it may travel towards the print zone once formed, even if the tensions are generated at different positions along the media path, for example downstream of the print zone.

Such tensions and media bubbles may arise especially, but not only, in large format printers that handle continuous media webs or wide media sheets; furthermore, the tendency to form bubbles may be increased when print media such as paper receives a printing fluid such as ink and becomes moist and therefore less rigid, for example in inkjet printing.

If a media bubble forms in the print zone, or travels to the print zone, it may reach the height of the printing modules, for example inkjet printheads.

Furthermore, this can occur quite easily since such modules are generally arranged at a small height above the media path to increase printing accuracy.

The contact of the media bubble with a printing module may be a serious problem, since it involves not only that the plot being printed is ruined, but also that the printing modules, which have a high cost, may be damaged; furthermore, the media may jam in the apparatus due to the contact with the printing module, and this situation may require manual intervention to remove the media and clean up the internal mechanism of the apparatus.

In some cases, for example in scanning printers in which the printing modules are mounted on a reciprocating carriage, the carriage may collide during its movement with a media bubble that has formed in the print zone causing a media jam and a serious degree of damage as described above.

With printing apparatus and methods according to examples described herein the risk of media jams, at least in the printing zone, is reduced.

Figure 2A:
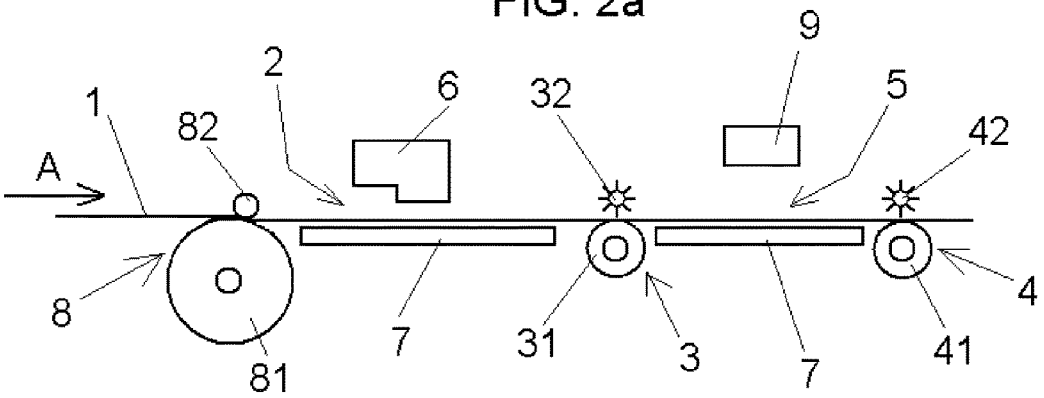
Figure 2B:
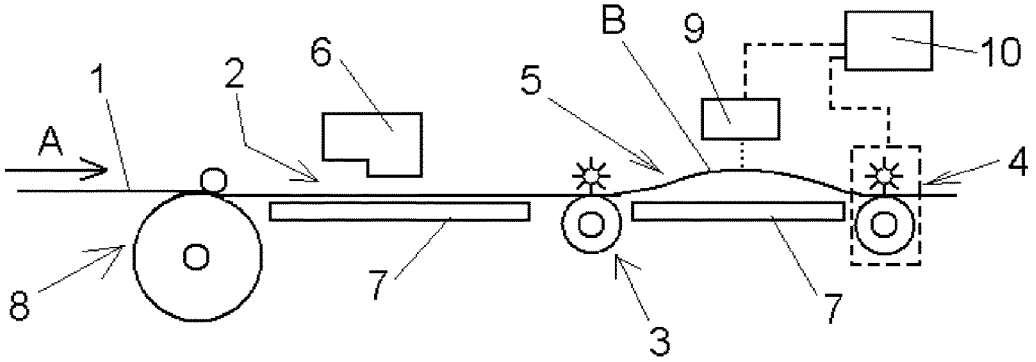
Figure 3:
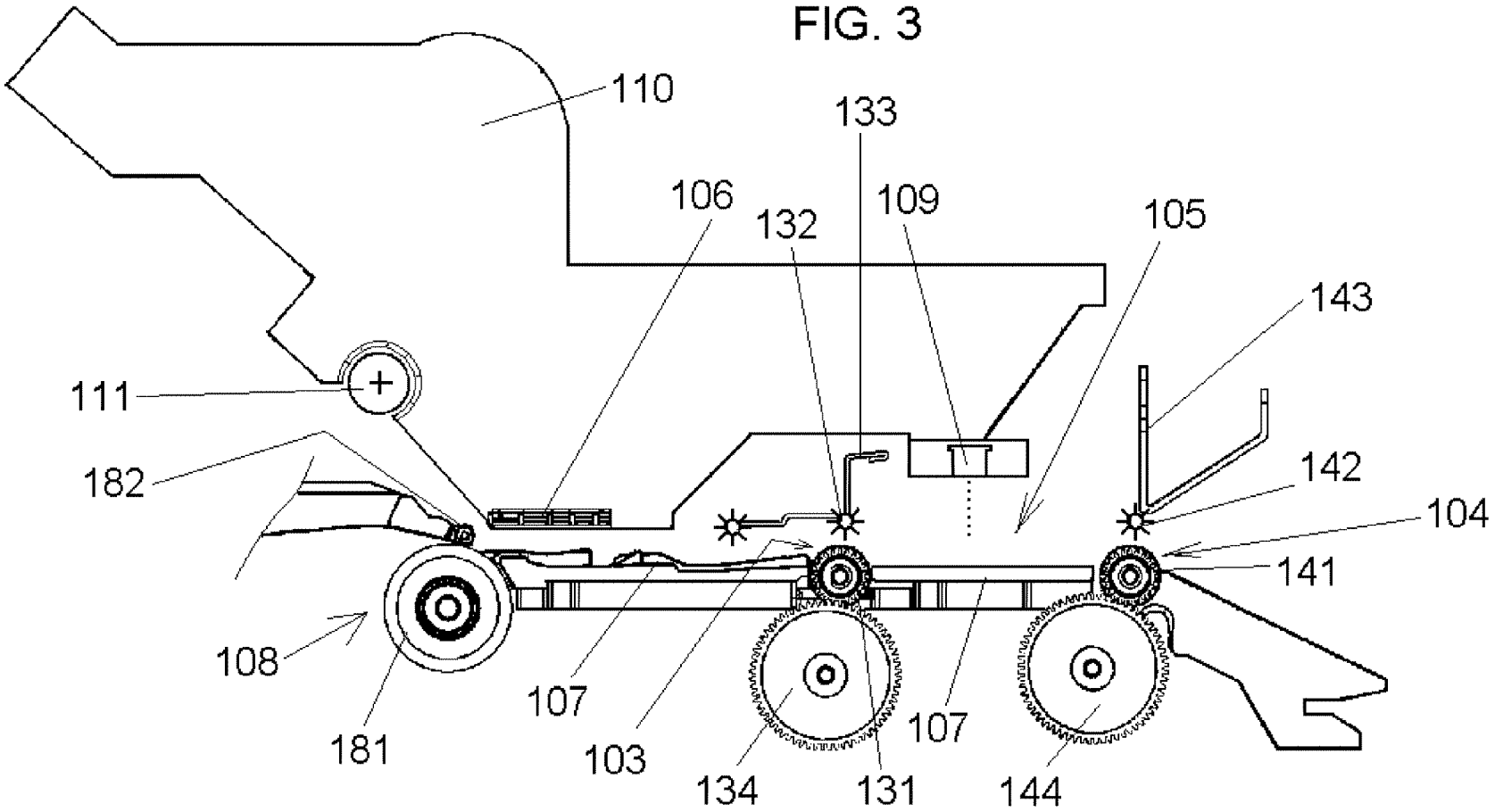

Some non-limiting examples will be described in the following with reference to the appended drawings, in which:

FIG. 1 illustrates very schematically an example of a printing apparatus as disclosed herein;

FIGS. 2*a* and 2*b* show very schematically another example of a printing apparatus as disclosed herein;

FIG. 3 shows schematically an example of a scanning printing apparatus as disclosed herein.

As shown in FIG. 1, in one example a print media 1, such as a web or a large sheet of paper, is advanced by a media handling system through a media path and a print zone 2 in a printing apparatus.

The media handling system in FIG. 1 may comprise a first media driving arrangement 3 positioned downstream of the print zone 2 in the direction of advance of the media, shown by arrow A, and a second media driving arrangement 4 which is positioned downstream of the first arrangement 3.

The second media driving arrangement may be operable to cause the tension of the media in a deformation zone 5, defined between the two driving arrangements 3 and 4, to be lower than in the print zone 2.

The provision of a deformation zone 5, in which the media may be less tensioned than in the print zone 2 by virtue of the action of the second media driving arrangement 4, allows reducing the risk that media bubbles form in the print zone 2, as explained in the following.

Stress or tension that may arise in the media at points of the media path where the media is not able to deform, e.g. because of the inertia of the media or due to the media path configuration, may tend to be transmitted towards the print zone. However, before any such stress can reach the print zone, the media is allowed to form a bubble in the deformation zone 5, because the media is here relatively loose, and therefore it is able to deform. The risk that such stress or tension is transmitted to the print zone 2 and the media forms a bubble there is therefore reduced. In other words, zone 5 is provided to accommodate deformations that may be caused by stress on the media, particularly downstream of the first driving arrangement 3.

As a consequence, the provision of the deformation zone 5 between the two driving arrangements 3 and 4 reduces the risk of media jam in the print zone and of damages associated therewith.

Furthermore, in the deformation zone 5 the free space above the media path may be made higher than in the print zone, where the available free space is small due to the presence of the printheads. Thus, even if a media bubble forms in the deformation zone 5 there is less risk of media jam, because there may be a relatively high space where the bubble can grow without contacting any surface of the apparatus.

FIGS. 2*a* and 2*b* show an example of a printing apparatus as disclosed herein, having a platen 7 below the media path to support the media 1, and a printing module 6, such as an inkjet printhead, above the media path in the printing zone 2, to deposit ink or other printing fluid on the media 1.

The media handling system in FIGS. 2*a* and 2*b* may comprise a media feed arrangement 8 upstream of the print zone 2, for example comprising a feed roller 81 in conjunction with an associated pinch wheel 82, and two media driving arrangements 3 and 4, both downstream of the print zone 2 and defining between them the deformation zone 5. The driving arrangements 3 and 4 may comprise overdrives, each with an overdrive roller 31, 41 to drive the media and an associated starwheel 32, 42 that contacts the upper side of the media and is rotated by the media advance. The starwheels 32, 42 may contact the printed side of the media without damaging the printed plot.

The overdrives 3 and 4 may allow an amount of slippage between the driving surface of the rollers 31, 41 and the surface of the media 1.

The media 1 may be maintained relatively tensioned in the print zone 2 by arranging the tangential speed of the surface of the driving roller 31 to be slightly higher than the tangential speed of the surface of the feed roller 81; the possibility of a small amount of slippage between the media and the overdrive 3 prevents the media from tearing.

In some examples, in order to cause the tension of the media in the deformation zone 5 to be lower than in the print zone 2, the overdrives may be operated such that the tangential speed of the surface of the driving roller 41 is lower than the tangential speed of the surface of the driving roller 31, i.e. the driving speed of the second overdrive 4 is lower than the driving speed of the first overdrive 3.

In other examples, a similar effect may be obtained by causing the pressure exerted on the media at the second overdrive 4 to be lower than at the first overdrive 3. This may be done by adjusting the pressure of the starwheels 32 and 42 on the media.

Therefore, in some examples the speed of the second overdrive 4 may be the same, or even higher, than that of the first driving arrangement 3: in such cases the pressure exerted by starwheel 42 on the media in the second overdrive 4 is set to be lower than the pressure exerted by starwheel 32, such that a higher degree of slippage is allowed in overdrive 4 than in driving arrangement 3, and consequently the media in the deformation zone 5 is subject to a low tension.

In case of mechanical stress acting on the media in the deformation zone 5 or further downstream, a media bubble 5 may tend to form in the deformation zone 5, as shown in FIG. 2*b*.

FIGS. 2*a* and 2*b* also show a sensor 9 that may be arranged above the media path in the deformation zone 5. The sensor 9 may be employed to detect if a media bubble B reaches a predetermined height.

The arrangement of a sensor 9 in the deformation zone 5 is relatively simple because of the free space available above the media path in this zone. The sensor may be mounted for example at a height of about 15 mm above the media path, and set to detect a media bubble that reaches a height of about 10 mm from the media path; there is thus a margin of about 5 mm to detect the bubble, and this allows using a relatively simple sensor and still ensure reliable detection and avoid false positives. For example an optical sensor with a digital detection/non-detection circuit may be used, which has a low cost and is easy to implement.

Detecting a bubble that reaches a predetermined height by means of a sensor 9 allows acting on the printing apparatus before a media jam occurs; for example a warning may be issued, and/or the printing operation may be stopped, and/or the printer may be operated to remove the bubble without stopping the printing operation and without the need for user intervention.

A controller may be connected to the sensor 9 in order to stop the printer and/or issue a warning in case of detection of a bubble.

In some examples of printing apparatus as disclosed herein, the driving speed and/or the pressure exerted on the media at the second overdrive 4 may be adjustable. In the example of FIGS. 2*a* and 2*b* this may be done by adjusting the speed of overdrive roller 41, or by adjusting the pressure of the starwheel 42.

If the speed and/or the pressure at the overdrive 4 are increased, a bubble B that is present in the deformation zone 5 (FIG. 2*b*) will tend to be reduced and the media will tend to flatten down again on the platen 7. This may allow a detected media bubble to be removed without the need to stop the printing operation and without requiring manual intervention of the user.

In some examples, such as shown in FIG. 2*b*, a controller 10 may be connected to the sensor 9 and to the second driving arrangement 4 for increasing or reducing the tension of the media in the deformation zone and thus attempt to remove a bubble that reaches a predetermined height.

The controller 10 may increase or decrease the tension of the media in the deformation zone 5 by respectively increasing or decreasing either the driving speed or the pressure on the media, as explained before.

FIG. 3 shows an example of a scanning printing apparatus having a carriage 110 that can reciprocate along a scan axis 111. A printing module 106 comprising for example inkjet printheads, may be mounted on carriage 110. As known, in such an apparatus a print media (not shown) is advanced in successive advance movements in the direction of arrow A over a platen 107. Between such advance movements, the carriage 110 is displaced in a direction perpendicular to the advance direction A and the printheads 106 apply printing fluid in swaths on the print media.

As shown in FIG. 3, in some examples the media handling mechanism may comprise a media feed arrangement 108 with a feed roller 181 and a pinch wheel 182, and two overdrives 103 and 104, with overdrive rollers 131, 141 and associated starwheels 132, 142, defining between them a deformation zone 105.

In such a scanning printing apparatus, a media bubble sensor 109 may be mounted on the reciprocating carriage 110, such that it travels above the media path in the deformation zone 105.

The starwheels 132, 142 of the first and second overdrives 103, 104 may be mounted on respective supports 133, 143 that are fixed to the frame (not shown) of the printing apparatus.

The rollers 131, 141 of the first and second overdrives 103, 104 may be driven by a single motor (not shown) or by two motors (not shown), through respective gearwheels 134, 144. In examples wherein the speed in the second overdrive 104 may need to be adjusted to attempt to remove a media bubble formed in the deformation zone 105, the overdrive 104 may preferably have a driving motor independent from that of the overdrive 103.

Also disclosed herein are methods for printing comprising causing print media advance through a media path comprising a print zone, wherein the media is driven with a first tension in the print zone, and with a second tension, lower than the first tension, in a deformation zone downstream of the print zone in the media advance direction.

Thus, the method may involve exerting a first pulling force on the media in the direction of advance at a first position downstream of the print zone, and a second pulling force, smaller than the first, at a second position further downstream of the print zone, such that the media may be relatively loose in the zone between the two positions and the media may be allowed to deform in this zone to accommodate stress or tensions to which the media may be subject.

In examples of the method, said deformation zone lies between a first media driving arrangement 3 positioned downstream of the print zone 2, and an overdrive 4 positioned downstream of the first media driving arrangement 3, as shown in the example of FIG. 1, said overdrive 4 allowing an amount of slippage with the media.

According to some examples, the method may further comprise detecting if a media bubble B, such as shown in FIG. 2*b*, forms in said deformation zone 5, or if a bubble in said zone has reached a predetermined height, and in case of positive detection controlling the media advance to prevent a media jam.

Controlling the media advance to prevent a media jam from occurring may simply involve stopping the media advance; generally the printing operation may be stopped or interrupted. A warning such as an acoustic and/or optical signal may be issued, and the user may be requested to manually solve the problem before printing is resumed or restarted.

In some examples of the method, in case a media bubble is detected, e.g. a bubble reaching a predetermined height, a media jam may be prevented by controlling the media advance such that the tension of the media in the deformation zone is increased to reduce the bubble.

This may be done, as described above, by increasing the speed and/or the pressure in the second overdrive 4: this may cause the media to be temporarily advanced slightly faster in the second overdrive 4 than in the first overdrive or driving arrangement 3, allowing the media forming the bubble to be taken up.

In some examples of the method for printing as disclosed herein, controlling the media advance to prevent a media jam once a bubble has been detected may involve first attempting to reduce the bubble by increasing the speed and/or the pressure in the second overdrive 4, and then interrupting the printing operation and issuing a warning for the user if it is found that the bubble may not be satisfactorily removed or controlled.

Such methods allow reducing the risk of media jam, and also reduce the need for user intervention and downtimes during printing, since part of the media bubbles that may be formed may be automatically reduced by controlling the media advance, and only in some case the user may need to solve the problem manually.

Examples of the arrangements and methods disclosed herein may be applied, amongst others, in large format printers, in which stress on the media due to mechanical causes, and thus the need to accommodate potential deformations, may occur more frequently due to the width of the media.

Although only a number of particular embodiments and examples have been disclosed herein, further variants and modifications of the disclosed print media products are possible; other combinations of the features of embodiments or examples described are also possible. Thus, the scope of the present invention should not be limited by particular examples or embodiments, but should be determined only by a fair reading of the claims that follow.

The invention claimed is:

1. A printing apparatus comprising a print zone and a media handling system for advancing media through a media path and through the print zone, wherein the media handling system comprises:

a first media driving arrangement positioned downstream of the print zone in a direction of advance of the media, a second media driving arrangement positioned downstream of the first media driving arrangement, wherein pressure exerted onto the media by the second media driving arrangement is lower than pressure exerted onto the media by the first media driving arrangement to cause a tension of the media in a deformation zone between the first and second media driving arrangements to be lower than a tension of the media in the print zone;

a sensor positioned in the deformation zone to detect that a bubble formed on the media has reached a predetermined height; and a controller connected to the sensor and to the second media driving arrangement, wherein, in response to a detection by the sensor, the controller is to decrease the pressure exerted onto the media by the second media driving arrangement to reduce the bubble formed on the media.

2. An apparatus as claimed in claim 1, wherein the second media driving arrangement includes a wheel to provide the pressure onto the media and a roller to move the media along the direction of advance, and wherein the wheel and the roller of the second media driving arrangement allow an amount of slippage with the media.

3. An apparatus as claimed in claim 2, wherein a driving speed of the roller of the second media driving arrangement is lower than a driving speed of the first media driving arrangement.

4. An apparatus as claimed in claim 2, wherein the wheel in the second media driving arrangement is a starwheel.

5. An apparatus as claimed in claim 3, wherein the driving speed of the roller of the second media driving arrangement is adjustable.

6. An apparatus as claimed in claim 2, wherein the pressure exerted on the media by the wheel in the second media driving arrangement is adjustable.

7. An apparatus as claimed in claim 1, wherein the sensor is arranged above the media path in the deformation zone.

8. An apparatus as claimed in claim 7, wherein the sensor is optical.

9. An apparatus as claimed in claim 7, wherein the controller is to increase or reduce the tension of the media in the deformation zone.

10. An apparatus as claimed in claim 9, wherein the second media driving arrangement allows an amount of slippage with the media, and the controller increases or decreases the tension of the media in the deformation zone by respectively increasing or decreasing a driving speed of the second media driving arrangement.

11. A method for printing comprising causing print media to advance through a media path comprising a print zone, wherein the media is driven with a first tension in the print zone, and with a second tension, lower than the first tension, in a deformation zone downstream of the print zone in the media advance direction, wherein the deformation zone includes a first media driving arrangement and a second media driving arrangement, the method comprising:

detecting, by a sensor positioned in the deformation zone, that a bubble formed on the media has reached a predetermined height; and in response to the detection by the sensor, decreasing, by a controller connected to the sensor and to the second media driving arrangement, pressure exerted onto the media by the second media driving arrangement in the deformation zone to reduce the bubble formed on the media.

12. A method as claimed in claim 11, wherein said deformation zone lies between a first media driving arrangement positioned downstream of the print zone and the second media driving arrangement positioned downstream of the first media driving arrangement, said second media driving arrangement allowing an amount of slippage with the media.

13. A method as claimed in claim 11, further comprising:

detecting whether a media bubble forms in said deformation zone, and in response to a detection that the media bubble forms in the deformation zone, controlling the advance of the media to prevent a media jam.

14. A method as claimed in claim 13, wherein in response to the detection that the media bubble forms in the deformation zone, preventing the media jam by stopping the advance of the media.

15. A method as claimed in claim 13, wherein in response to the detection that the media bubble forms in the deformation zone, preventing the media jam by controlling a speed of the second media driving arrangement such that the tension of the media in the deformation zone is increased to reduce the bubble.

16. A method for printing comprising:

causing print media to advance through a media path comprising a print zone and a deformation zone, wherein:

the deformation zone is located between a first media driving arrangement downstream of the print zone in the media advance direction and a second media driving arrangement further downstream of the print zone in the media advance direction;

the first media driving arrangement includes a first overdrive roller and a first wheel;

the second media driving arrangement includes a second overdrive roller and a second wheel; and the print media is to advance through the media path by: exerting, via contact of the first overdrive roller and the first wheel with the media, a first pulling force on the media in the direction of advance at a first position downstream of the print zone to move media along the direction of advance, the first pulling force to drive the media with a first tension;

causing a deformation of the media in the deformation zone based on the first tension exerted on the media by the first media driving arrangement and a second tension exerted on the media by the second media driving arrangement, wherein the deformation is caused by: exerting, via contact of the second overdrive roller and the second wheel with the media, a second pulling force on the media to drive the media with a second tension, wherein the second pulling force is greater than zero and is less than the first pulling force to cause, in the deformation zone, the second tension of the media to be lower than the first tension;

detecting, by a sensor positioned in the deformation zone, that a bubble formed on the media has reached a predetermined height; and in response to a detection by the sensor, decreasing, by a controller connected to the sensor and to the second media driving arrangement, the second tension exerted on the media by the second media driving arrangement to reduce the bubble formed on the media.

* * * * *